United States Patent [19]

Tokuhiro et al.

[11] Patent Number: 4,957,190

[45] Date of Patent: Sep. 18, 1990

[54] APPARATUS FOR CONVEYING REFUSE CONTAINERS

[75] Inventors: Tomoya Tokuhiro; Teruhiko Miyauchi; Koshin Kikuchi; Teruhiko Momoi, all of Tokyo, Japan

[73] Assignee: Shimizu Construction Co., Ltd., Tokyo, Japan

[21] Appl. No.: 316,938

[22] Filed: Feb. 28, 1989

[51] Int. Cl.[5] ..... B66B 9/00

[52] U.S. Cl. ..... 187/32; 187/3; 187/16; 187/95; 414/795.2; 414/798.1

[58] Field of Search ..... 187/3, 5, 16, 75, 32, 187/95; 414/797.5, 798, 798.1, 795.2

[56] References Cited

U.S. PATENT DOCUMENTS

| | | | |
|---|---|---|---|
| 628,828 | 7/1899 | Mentzer | 187/5 |
| 925,727 | 6/1909 | Rowe | 187/3 |
| 1,249,756 | 12/1917 | Holmgren | 187/3 X |
| 1,936,212 | 11/1933 | Scott | 187/16 X |
| 2,429,523 | 10/1947 | Murphy | 183/3 X |
| 3,608,674 | 9/1971 | Phillips | 187/3 |

FOREIGN PATENT DOCUMENTS

| | | | |
|---|---|---|---|
| 7904216 | 12/1980 | Netherlands | 187/3 |

OTHER PUBLICATIONS

The Storm Manufacturing Co., Catalog of Dumb Waiters and Elevators, 1898.

PCT/JP87/01014, no date.

*Primary Examiner*—Robert J. Spar

*Assistant Examiner*—John Vanden Bosche

*Attorney, Agent, or Firm*—Oblon, Spivak, McClelland, Maier & Neustadt

[57] ABSTRACT

The present invention relates to an apparatus for conveying refuse containers in a structure such as an office building. The apparatus includes (a) a generally vertical shaft passing through a plurality of floors in the structure; (b) a longitudinally elongated cab suitable for being positioned in the shaft, the elongated cab containing a plurality of refuse containers in such a manner that the refuse containers are vertically aligned, and having a plurality of lateral windows as portals at least at the top and bottom of the elongated cab for the refuse containers; (c) a first lift installed in the shaft, the first lift moving the elongated cab up and down in a generally vertical line throughout the shaft. Thereby, the refuse containers loaded into the elongated cab are vertically conveyed by the first lift. In addition, if a second lifting mechanism is installed in the elongated cab for moving the refuse containers up and down in a generally vertical line throughout the elongated cab, the refuse containers are prevented from falling too fast and being damaged during the loading and unloading of the refuse containers.

3 Claims, 3 Drawing Sheets

APPARATUS FOR CONVEYING REFUSE CONTAINERS

BACKGROUND OF THE INVENTION

1. Field of the Invention:

This invention relates to an apparatus for conveying refuse containers in a structure such as an office building.

2. Discussion of the Background:

Conventionally, refuse collection in an office building requires cleaning personnel to walk around every floor, collecting refuse in containers, e.g., large buckets, and bringing the container to a predetermined place by taking an elevator. Afterwards, the refuse will be brought out from the building and be stored at the location until it is gathered by a sweeper etc.

In this case, however, the cleaning personnel spend much time walking between the floor and the collection site, and/or for waiting for the elevator coming. Furthermore, since the elevator will be utilized by many people including visitors and residents, it is not desirable to use the elevator to transport refuse, as this may soil the elevator and produce undesirable odors.

SUMMARY OF THE INVENTION

Accordingly, it is an object of the invention to provide an apparatus for conveying refuse containers in a structure, which is independent of the passenger elevator.

Another object of the present invention is to provide an apparatus for conveying refuse containers for high efficiency refuse collection.

Furthermore, it is an object of the present invention to provide the apparatus which can prevent the refuse containers from damage during conveyance.

Other objects and advantages of the present invention will become apparent from the detailed description to follow taken in conjunction with the appended claims In carrying out the present invention in one preferred embodiment, the apparatus includes (a) a generally vertical shaft passing through a plurality of floors in the structure; (b) a longitudinally elongated cab equipped in the shaft, the elongated cab containing a plurality of refuse containers in such a manner that the refuse containers are vertically aligned, and having a plurality of lateral windows as portals at least at the top and bottom of the elongated cab for the refuse containers; (c) a first lift installed in the shaft, the first lift moving the elongated cab up and down in a generally vertical line throughout the shaft. Thereby, the refuse containers loaded into the elongated cab are vertically conveyed by the first lift. In addition, if a second lifting means is installed in the elongated cab for moving the refuse containers up and down in a generally vertical line throughout the elongated cab, the refuse containers are prevented from falling too fast and being damaged during the loading and unloading of the refuse containers.

A more complete appreciation of the invention and many of the attendant advantages thereof will be readily obtained as the same becomes better understood by reference to the following detailed description when considered in connection with the accompanying drawings, wherein:

DESCRIPTION OF THE PREFERRED EMBODIMENTS

Figure 1:
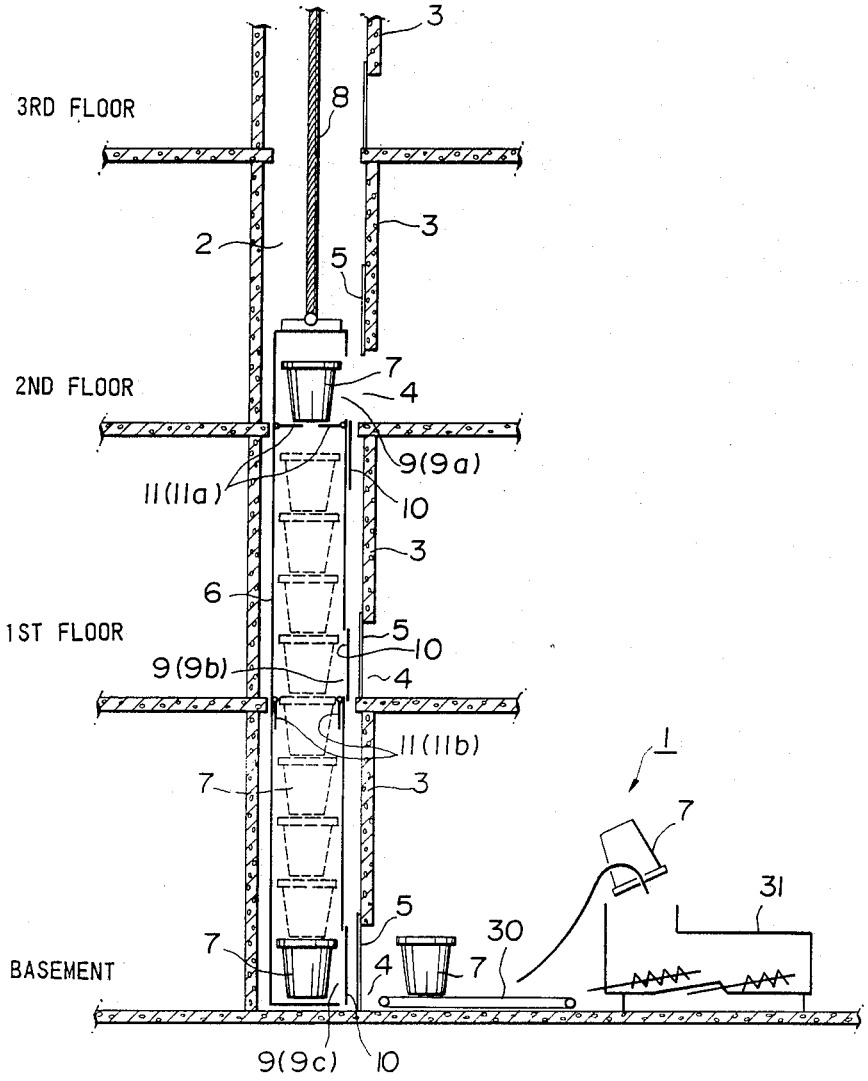
FIG. 1 is an elevated side view section of a portion of a building which comprises an apparatus for conveying refuse containers according to a preferred embodiment of the present invention.

Preferred embodiments of the present invention will be explained hereinafter in greater detail with identical reference numerals denoting similar members or elements.

FIG. 1 shows an elevated side view section of a portion of the building which comprises an apparatus for conveying refuse containers according to a preferred embodiment of the present invention. As shown in FIG. 1, refuse collection site 1 is in the basement of the building. The building has vertical shaft 2 passing through the basement to the top floor (not shown), which is surrounded by side walls 3 installed on each of the floors. Every wall 3 has window 4 and door 5 which is usually closed for fire containment. Every window 4 faces in the same direction.

In shaft 2, longitudinally elongated cab 6 for containing cylindrical refuse containers 7 is suspended by hoist cable 8. Hoist cable 8 and a winding mechanism (not shown) which winds up and unwinds hoist cable 8 are provided so as to constitute a first lift. The first lift installed in shaft 2 moves elongated cab 6 up and down in a generally vertical line through shaft 2. Cab 6 is more than ten times the length of refuse container 7. The rectangular cross section of cab 6 is of a suitable size for encompassing one refuse container 7. Furthermore, since elongated cab 6 is of a suitable size for encompassing one refuser container 7, the refuser containers 7 are vertically aligned. When cab 6 is in the basement, the top of cab 6 is on the 2nd floor. Cab 6 has three lateral windows 9 as portals for refuse containers 7 which are at the top, middle, and bottom sections of cab 6. When cab 6 is in the basement, the heights of the top, middle, and bottom windows 9 (9*a*, 9*b*, 9*c*) are at the same level as windows 4 on the 2nd floor, the 1st floor, and the basement, respectively. Windows 9 are usually shut by doors 10.

Figure 4:
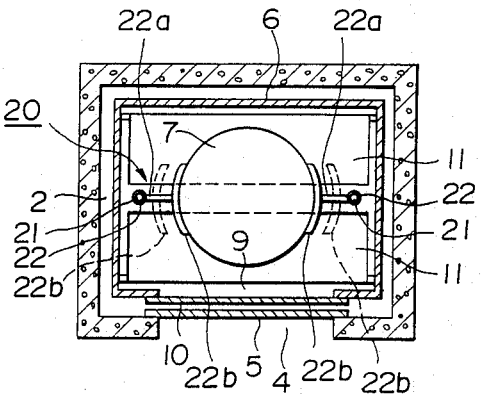
FIG. 4 is a plan view of an apparatus shown in FIGS. 2 and 3.
Figure 2:
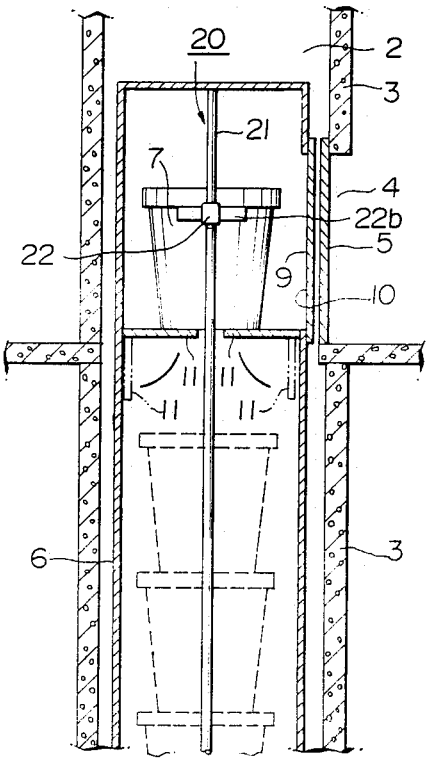
FIG. 2 is an enlarged elevated side view section of the apparatus shown in FIG. 1.
Figure 3:
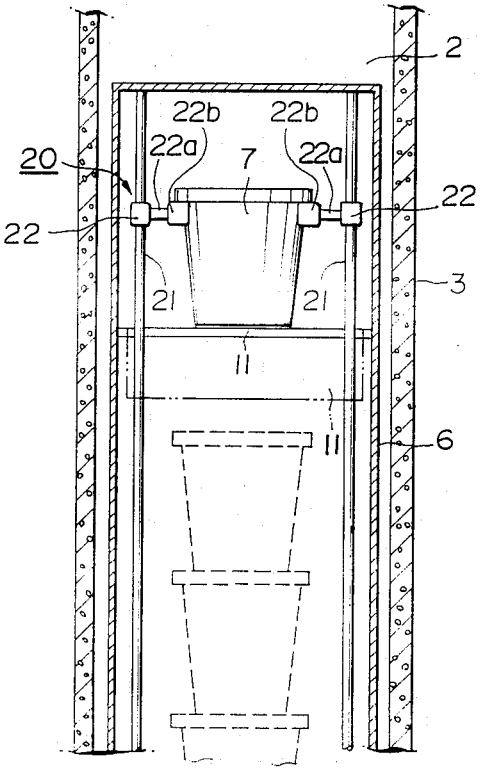
FIG. 3 is an elevated sectional view of an apparatus shown in FIG. 2.
Figure 5A:
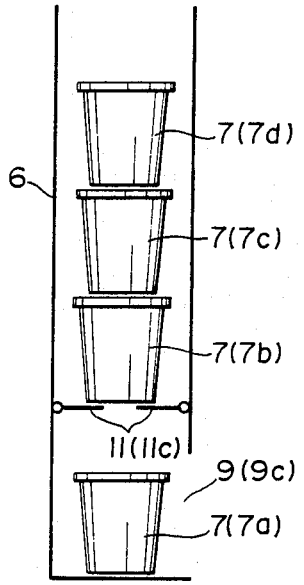
FIG. 5A is a simplified side elevational view of a lowermost portion of a cab of the apparatus shown in FIG. 1, when a first loaded refuse container is located on a bottom floor of the cab.
Figure 5B:
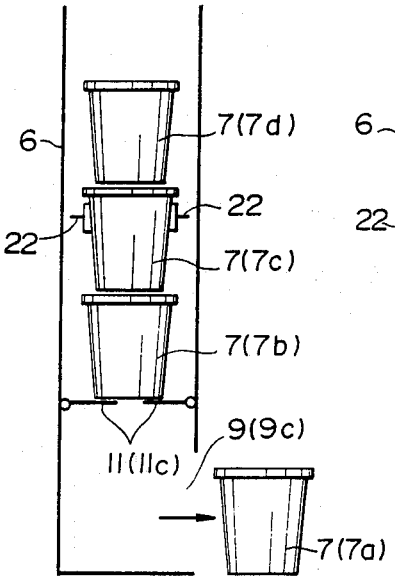
FIG. 5B is a simplified side elevational view of the lowermost portion of the cab of the apparatus shown in FIG. 1, when a first loaded refuse container is removed from the cab.
Figure 5C:
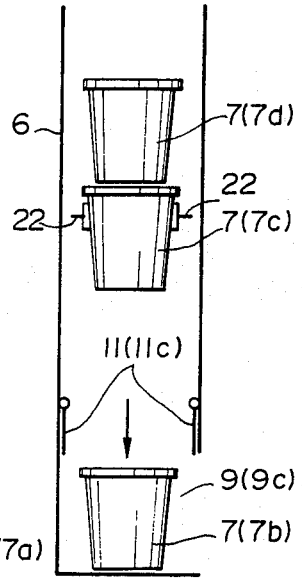
FIG. 5C is a simplified side elevational view of the lowermost portion of the cab of the apparatus shown in FIG. 1, when a second loaded refuse container is located on a bottom floor of the cab.
Figure 5D:
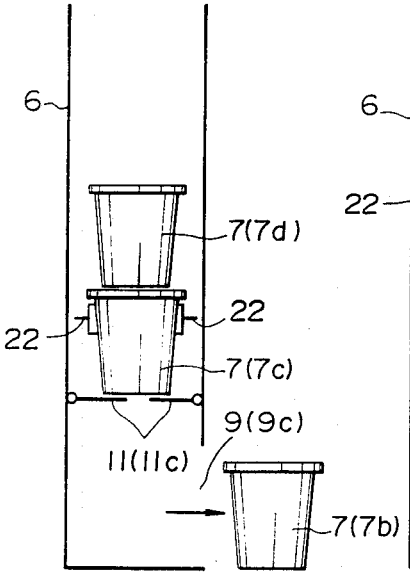
FIG. 5D is a simplified side elevational view of the lowermost portion of the cab of the apparatus shown in FIG. 1, when a second loaded refuse container is removed from the cab.
Figure 5E:
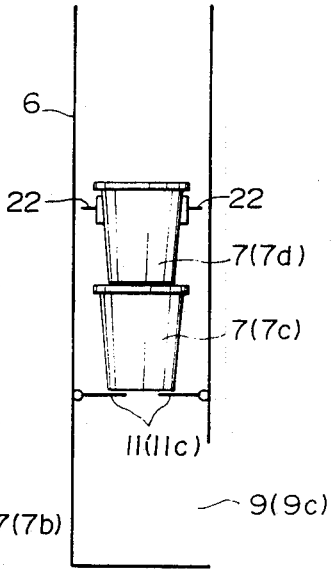
FIG. 5E is a simplified side elevational view of the lowermost portion of the cab of the apparatus shown in FIG. 1, directly after a second loaded refuse container is removed from the cab.

As shown in FIGS. 2, 3, and 4, cab 6 has second lift 20 for refuse container 7, including a pair of vertical guide rods 21 extending between the top and the bottom (not shown) of cab 6, a pair of holders 22 to hold refuse container 7, each of which is supported by guide rods 21, and a driving means (not shown) which can spin guide rods 21 around their own axes respectively. Guide rods 21 have external threads. Holders 22 have internal threads, thereby each of the guide rods 21 and each of the holders 22 are engaged. When the driving means spins guide rods 21, holders 22 along with refuse container 7 are raised or lowered vertically due to the engagement with guide rods 21. Each of the holders 22 has an arm 22*a* extending toward another holder 22 and a curved plate 22*b* attached to the arm 22*a*, so that the inner faces of curved plates 22*b* are oposed to each other. The inner faces of curved plates 22*b* have a curvature conforming to the shape of refuse container 7. Both arms 22*a* are controlled to coaxially extend and retract, so that refuse container 7 can be tightly held between the pair of curved plates 22*b*. In order to be extended and retracted, arms 22*a* include mechanisms (not shown), such as hydraulic systems.

A pair of hinged boards 11 (11*a*) are provided in cab 6 directly beneath top window 9*a*. Hinged boards 11 are affixed to the internal surfaces of side walls of cab 6. Hinged boards 11 can be synchronously controlled, to be horizontal or turned downward at hinges 12, thereby the internal space directly beneath top window 9 (9*a*) is shut or opened. Hinged boards 11 include opening and shutting mechanisms (not shown), such as hydraulic jacks. As shown in FIG. 1, another pair of hinged boards 11 (11*b*), which are the same as the above described pair, are provided directly beneath intermediate window 9 (9*b*). As shown in FIG. 5, it is more preferred that another pair of hinge boards 11 (11*c*) be provided directly above bottom window 9 (9*c*).

Returning to FIG. 1, prescribed refuse collection site 1 has a arrangement as follows. In front of window 4 in the basement, conveyor belt 30 for conveying refuse containers 7 is installed. Refuse containers 7 removed from cab 6 are mounted on conveyor belt 30 to be horizontally conveyed to refuse compactor 31. The refuse containers 7 are then removed and are emptied by an emptying apparatus (not shown), for emptying the refuse into refuse compactor 31.

The operation of the apparatus for conveying refuse containers is described in the following. The operation is automatically controlled by a computer. Cleaning personnel on a floor controls the first lift so that top window 9*a* of cab 6 is at the same level as the window 4 of that floor. A button is pushed in a manner similar to that of passenger elevators. Then, both top door 10 and door 5 open. At that time, the upper pair of boards 11*a* are horizontal and the intermediate pair of boards 11*b* are down. The holders 22 are located above upper boards 11*a*.

The cleaning personnel load refuse container 7 on the upper boards 11 (11*a*), which allows holders 22 to hold container 7, and then shut doors 5 and 10. When upper boards 11*a* open down, holders 22 and container 7 are lowered along the guide rods 21. When container 7 reaches the bottom of cab 6 or the top of another container 7 which has been loaded into cab 6, holders 22 release container 7. (When the lower pairs of boards 11*c* are used, containers 7 are loaded into cab 6 in the manner mentioned later). Holders 22 return to the initial position above upper boards 11*a*. The upper boards 11*a* then turn horizontally. The cleaning personnel open doors 5 and 10 and again lowers another container 7 until there are no more refuse containers 7 on the floor. The cleaning personnel then go to another floor and repeat the operation.

When the cleaning personnel convey refuse containers 7 from the 1st floor, cab 6 should be in the basement. Holders 22 are controlled to be located directly above intermediate boards 11 (11*b*). Intermediate boards 11*b* are controlled to be horizontal. Refuse containers 7 are on intermediate boards 11*b*. The operation will follow as described above. The space under intermediate boards 11*b* must not be filled by containers 7.

If cab 6 is filled with refuse containers 7, cab 6 is lowered so as to be in the basement. The door 4 in the basement and bottom door 10 are opened. Refuse containers 7 are removed from cab 6. The refuse in containers 7 is emptied into compactor 31. While removing the lowest refuse container 7, holders 22 hold the refuse container 7 directly above the one to be removed supporting the weight of all the other containers 7 above.

FIG. 5 is a schematic representation of the preferred process for removing refuse containers 7 from the apparatus. In this method, as shown in FIG. 5 (A), the first loaded refuse container 7 (7*a*) is put on the bottom floor of cab 6. The lower pairs of boards 11 (11*c*) are controlled to be horizontal. The second, third, and fourth refuse containers 7 (7*b*–7*d*) stacked vertically on boards 11*c*. The first container 7*a* is removed from cab 6 through window 9 (9*c*) as shown in FIG. 5 (B). Holders 22 hold the third container 7*c* and support the containers 7*c* and 7*d*. The boards 11*c* are then opened so that the second container 7 falls on the bottom floor of cab 6 as shown in FIG. 5 (C). The boards 11*c* are shut again as shown in FIG. 5 (D). Then, holders 22 are lowered so that the third container 7*c* is put on the boards 11*c*. The second container 7*b* is removed from cab 6. The holders 22 are raised to hold the fourth container 7*d* as shown in FIG. 5 (E). The above operation is repeated as necessary.

In this method, because container 7 to be removed does not support containers 7 above it, the removal of the container 7 is easy. Because the containers 7 fall to the bottom floor one by one, the containers 7 do not impact with great force, and so prevents the containers 7 from damage, and prevents the spilling of refuse.

According to the above apparatus for conveying refuse containers, it is unnecessary for the cleaning personnel to go from the refuse collection site to the various floors of the building. The cleaning personnel should only needs to load the containers 7 on each of the floors, moving on to other floors until cab 6 is full, then remove the containers 7 at refuse collection site 1. Because cab 6 is longitudinally elongated, it has a high capacity for refuse containers 7, and so trips between the refuse collection site and the floors of the building, and the waiting time after calling cab 6 are reduced. Therefore, cleaning personnel spend less time in transit and collection efficiency is improved.

Cab 6 is more than ten times the length of refuse container 7. The rectangular cross section of cab 6 is of a suitable size for encompassing one refuse container 7. Furthermore, since elongated cab 6 is of a suitable size for encompassing one refuse container 7, the refuse containers 7 are vertically aligned. Therefore, the apparatus occupies little floor space and the building need not be extensively modified.

Because cab 6 has second lift 20 which holds and moves the containers 7 one by one in order to prevent a long fall, damage to the containers 7 is prevented, and the refuse will not spill from the containers 7.

While only the process of refuse collection is described in the above, the apparatus may also be used to return the refuse containers 7 to their respective floors.

Although a preferred embodiment of the invention has been shown and described herein, there is no intention to limit the invention to the details of such an embodiment. On the contrary, it is intended that the invention cover all the various modifications, alterations, substitutions and equivalents that may fall within the spirit and scope of the invention.

Examples of modifications and alterations will be described hereinafter.

One example is as follows. The shape of the cab conforms to the shape of the refuse container 7. The cab is of a cross section only slightly larger than their of the refuse containers 7. The cab includes two lateral windows at the top and bottom of the cab, and two doors to close the windows. When the doors are closed, the cab can be airtight. Then, the falling refuse container 7 will pass through the cab vertically, and the velocity of the container 7 will be low because of air resistance. Therefore, it is possible to prevent damage to the container without the special mechanism for lowering container 7.

In the above embodiment, the refuse containers 7 are lowered one by one, to be stacked one above the other with second lift 20. However, it is also possible that the cab includes shelves at uniform intervals which may contain a container 7. In this case, it is preferred that one of the lateral walls of the cab 6 be substituted by doors, and that the shaft 2 through which the cab 6 moves extends below the level of the basement. In order to load containers 7 onto the shelves, or to unload containers 7 from the shelves, cab 6 is controlled to move up or down one shelf at a time. If the shaft 2 ends at the floor level of basement, then it is preferred that every shelf has a structure similar to the above-described pairs of hinged boards 11. In this case, the containers 7 are individually moved up and down by the second lift 20, or the containers are lowered by gravity one level at a time.

The shelves prevent the lower containers 7 from being crushed by the weight of the upper containers 7. When the containers 7 are loaded, it is unnecesssary to use the second lift 20 for lowering the containers 7, thereby quick loading is assured. Because the cab is longitudinally elongated, the containers 7 can be loaded into the shelves from a plurality of floors simultaneously.

Obviously, numerous modifications and variations of the present invention are possible in light of the above teachings. It is therefore to be understood that within the scope of the appended claims, the invention may be practiced otherwise than as specifically described herein.

What is claimed is:

1. An apparatus for conveying refuse containers in a structure, the apparatus comprising:

a plurality of refuse containers;

a generally vertical shaft passing through a plurality of floors in the structure;

a longitudinally elongated cab positioned in said shaft, said elongated cab having a height which extends over at least two of the plurality of floors in the structure, the elongated cab containing said plurality of refuse containers in such a manner that the refuse containers are vertically aligned, and having a plurality of lateral windows as portals at least at the top and bottom of the elongated cab for the refuse containers;

first lifting means installed in the shaft for moving said elongated cab up and down in a generally vertical line throughout said shaft; and second lifting means disposed in the elongated cab for moving said refuse containers up and down in a generally vertical line throughout the elongated cab, the second lifting means comprising an elongated guide means generally vertically extending through substantially the entire height of the cab, and holding means for holding the refuse container, the holding means being movable upward and downward with respect to said guide means.

2. An apparatus for conveying refuse containers according to claim 1, wherein said elongated cab includes a plurality of horizontal loading means for loading the refuse container thereon, the loading means being located directly beneath the windows respectively, and wherein said elongated cab further includes means for opening each of the loading means so as to open a horizontal cross section of the elongated cab such that the container can pass therethrough.

3. An apparatus for conveying refuse containers in a structure, the apparatus comprising:

a plurality of refuse containers;

a generally vertical shaft passing through a plurality of floors in the structure;

a longitudinally elongated cab positioned in said shaft, said elongated cab including means for containing said plurality of refuse containers in such a manner that said refuse containers are vertically aligned, the elongated cab including a plurality of shelves at substantially uniform intervals which respectively accommodate said refuse containers; each of said shelves being pivotally openable in a horizontal cross section so that one of said containers can pass therethrough, wherein said elongated cab has a plurality of lateral windows which comprise portals at least at a top and bottom portion of the elongated cab for the refuse containers;

first lifting means positioned in said shaft, for moving said elongated cab up and down in a generally vertical line throughout said shaft and second lifting means disposed in the elongated cab for moving said refuse containers up and down in a generally vertical line throughout the elongated cab.

* * * * *